US006340037B1

(12) United States Patent
Stafford

(10) Patent No.: US 6,340,037 B1
(45) Date of Patent: Jan. 22, 2002

(54) BAG SUPPORTING DEVICE

(76) Inventor: Timothy J. Stafford, 1216 W. 27th Ave., Kennewick, WA (US) 99337

( * ) Notice: Subject to any disclaimer, the term of this patent is extended or adjusted under 35 U.S.C. 154(b) by 0 days.

(21) Appl. No.: 09/727,411

(22) Filed: Dec. 1, 2000

(51) Int. Cl.[7] ..... B65B 1/04
(52) U.S. Cl. ..... 141/316; 141/391
(58) Field of Search ..... 141/313–316, 141/391

(56) References Cited

U.S. PATENT DOCUMENTS 3,915,329 A 10/1975 Zaks
4,749,011 A * 6/1988 Rylander ..... 141/316
4,955,496 A 9/1990 Nelson
4,979,547 A 12/1990 Hoerner
5,226,554 A 7/1993 Dauphinais
D347,577 S 6/1994 Dire
5,716,033 A * 2/1998 Gibson ..... 248/95
5,871,037 A 2/1999 Feldt
6,065,512 A * 5/2000 Munn, II ..... 141/391

* cited by examiner

*Primary Examiner*—Steven O. Douglas

(57) ABSTRACT

A bag supporting device for supporting a collapsible bag. The bag supporting device includes a panel comprising a resiliently flexible material. The panel has a generally rectangular shape. The panel has an top edge, a bottom edge, and a pair of lateral side edges. The bottom and top edges have a length generally between 5 feet and 7 feet and each of the lateral edges has a length generally between 2½ feet and 3½ feet.

11 Claims, 3 Drawing Sheets

BAG SUPPORTING DEVICE

BACKGROUND OF THE INVENTION

1. Field of the Invention

The present invention relates to bag supporting devices and more particularly pertains to a new bag supporting device for supporting a collapsible bag in a vertical orientation.

2. Description of the Prior Art

The use of bag supporting devices is known in the prior art. More specifically, bag supporting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,226,554; U.S. Pat. No. 4,955,496; U.S. Pat. No. 347,577; Des. U.S. Pat. No. 3,915,329; U.S. Pat. No. 5,871,037; and U.S. Pat. No. 4,979,547.

While these devices fulfill their respective, particular objectives and requirements, the aforementioned patents do not disclose a new bag supporting device. The inventive device includes a panel comprising a resiliently flexible material. The panel has a generally rectangular shape. The panel has an top edge, a bottom edge, and a pair of lateral side edges. The bottom and top edges have a length generally between 5 feet and 7 feet and each of the lateral edges has a length generally between 2½ feet and 3½ feet.

In these respects, the bag supporting device according to the present invention substantially departs from the conventional concepts and designs of the prior art, and in so doing provides an apparatus primarily developed for the purpose of supporting a collapsible bag.

SUMMARY OF THE INVENTION

In view of the foregoing disadvantages inherent in the known types of bag supporting devices now present in the prior art, the present invention provides a new bag supporting device construction wherein the same can be utilized for supporting a collapsible bag.

The general purpose of the present invention, which will be described subsequently in greater detail, is to provide a new bag supporting device apparatus and method which has many of the advantages of the bag supporting devices mentioned heretofore and many novel features that result in a new bag supporting device which is not anticipated, rendered obvious, suggested, or even implied by any of the prior art bag supporting devices, either alone or in any combination thereof.

To attain this, the present invention generally comprises a panel comprising a resiliently flexible material. The panel has a generally rectangular shape. The panel has an top edge, a bottom edge, and a pair of lateral side edges. The bottom and top edges have a length generally between 5 feet and 7 feet and each of the lateral edges has a length generally between 2½ feet and 3½ feet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bag supporting device apparatus and method which has many of the advantages of the bag supporting devices mentioned heretofore and many novel features that result in a new bag supporting device which is not anticipated, rendered obvious, suggested, or even implied by any of the prior art bag supporting devices, either alone or in any combination thereof.

It is another object of the present invention to provide a new bag supporting device which may be easily and efficiently manufactured and marketed.

It is a further object of the present invention to provide a new bag supporting device which is of a durable and reliable construction.

An even further object of the present invention is to provide a new bag supporting device which is susceptible of a low cost of manufacture with regard to both materials and labor, and which accordingly is then susceptible of low prices of sale to the consuming public, thereby making such bag supporting device economically available to the buying public.

Still yet another object of the present invention is to provide a new bag supporting device which provides in the apparatuses and methods of the prior art some of the advantages thereof, while simultaneously overcoming some of the disadvantages normally associated therewith.

Still another object of the present invention is to provide a new bag supporting device for supporting a collapsible bag.

Yet another object of the present invention is to provide a new bag supporting device which includes a panel comprising a resiliently flexible material. The panel has a generally rectangular shape. The panel has an top edge, a bottom edge, and a pair of lateral side edges. The bottom and top edges have a length generally between 5 feet and 7 feet and each of the lateral edges has a length generally between 2½ feet and 3½ feet.

Still yet another object of the present invention is to provide a new bag supporting device that has a plurality of slots therein for gripping the device and for acting as handles.

Even still another object of the present invention is to provide a new bag supporting device that has rounded corners for preventing puncturing of a bag the device is placed in.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
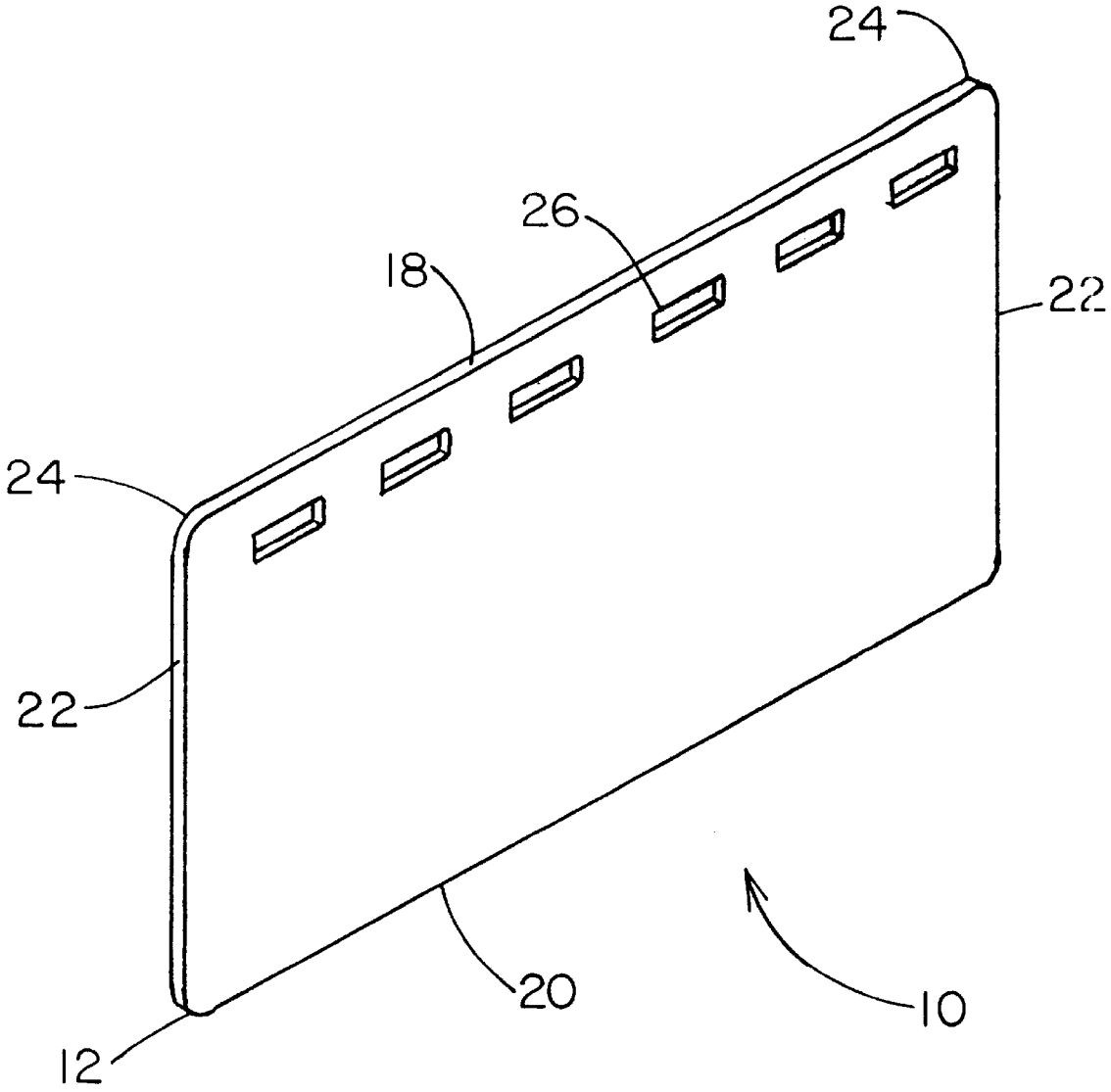
FIG. 1 is a schematic perspective view of a new bag supporting device according to the present invention.
Figure 2:
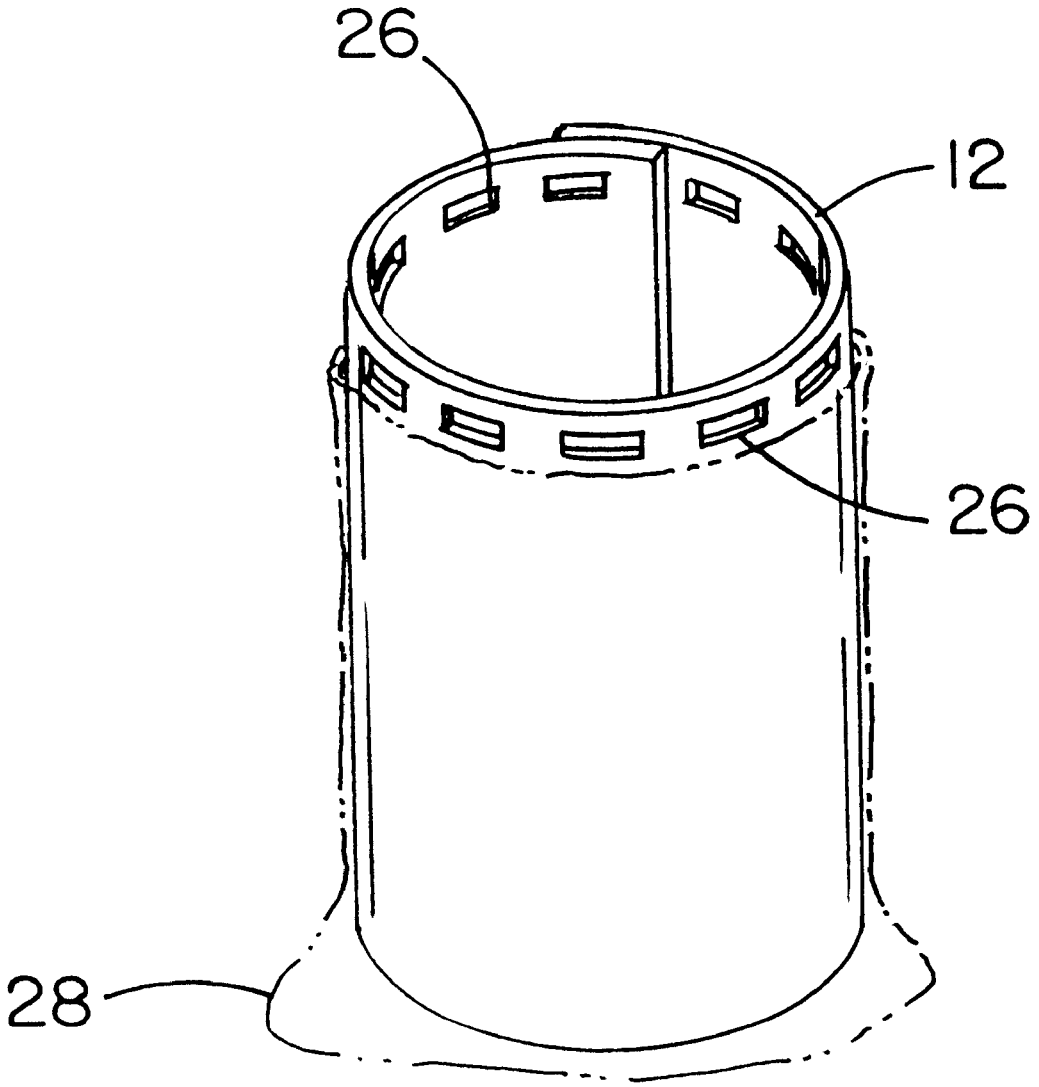
FIG. 2 is a schematic perspective in use view of the present invention.
Figure 3:
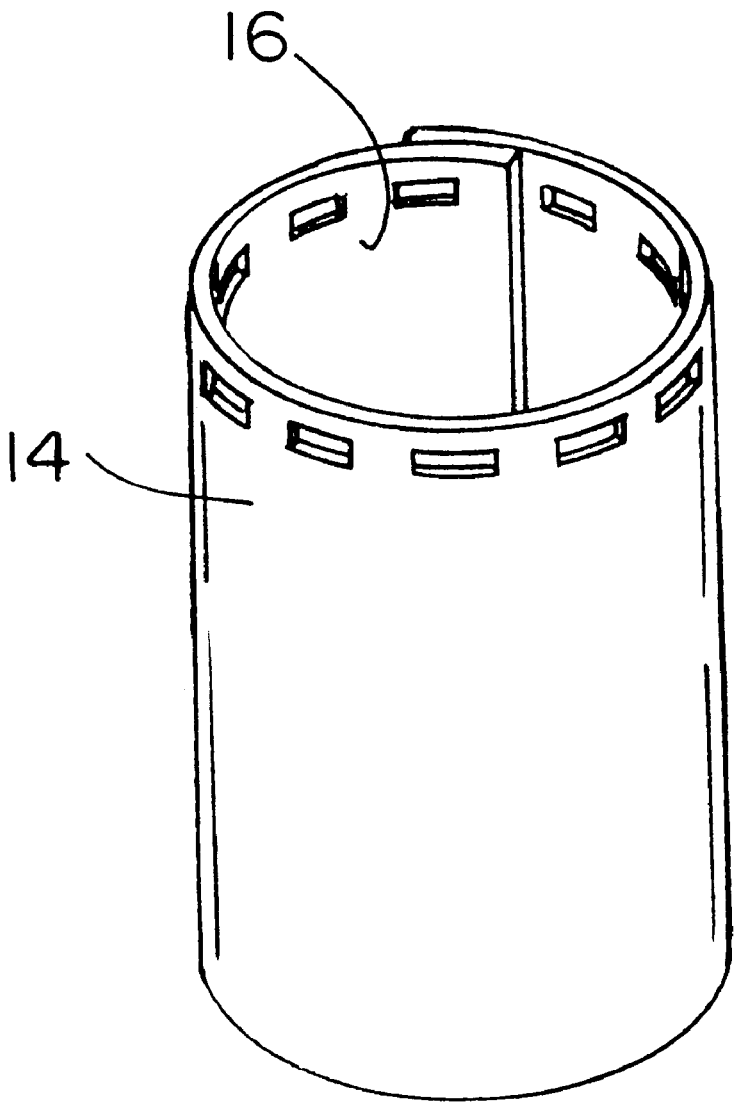
FIG. 3 is a schematic perspective view of the present invention.

With reference now to the drawings, and in particular to FIGS. 1 through 3 thereof, a new bag supporting device embodying the principles and concepts of the present invention and generally designated by the reference numeral 10 will be described.

As best illustrated in FIGS. 1 through 3, the bag supporting device 10 generally comprises a panel 12. The panel 12 comprises a resiliently flexible material having a generally rectangular shape. The panel 12 has a front surface 14, a back surface 16, a top edge 18, a bottom edge 20, and a pair of lateral side edges 22. The panel 12 has rounded corners 24. The bottom 18 and top 20 edges have a length generally between 5 feet and 7 feet. Each of the lateral edges 22 have a length generally between 2½ feet and 3½ feet and the panel preferably has a thickness generally between 3/32 inches and ⅛ inches. The panel 12 has a plurality of aligned slots 26 extending through the front and back surfaces. The slots 26 are generally aligned and extend between the lateral side edges 22. The slots 24 are positioned generally adjacent to the top edge 22. The resiliently flexible material preferably comprises a plastic.

In use, the panel 12 is rolled into a cylindrical shape and placed into a collapsible bag 28. The user then releases the panel such that the panel 12 unrolls in the bag 28. The slots 26 may be used as a handle for moving the bag and for removing the panel 12 from the bag 28. The corners 24 of the panel are rounded to prevent puncturing the bag 28.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bag supporting device positionable in a collapsible bag, said device comprising:

an elongate panel comprising a resiliently flexible material, said panel having a front surface, a back surface, an top edge, a bottom edge, and a pair of lateral side edges, a plurality of slots being formed through said panel adjacent only the top edge, said plurality of slots being elongate for receiving a hand of a user for gripping said panel, each of the slots of said plurality of slots having a common longitudinal axis extending through each of said slots, said common longitudinal axis extending in a longitudinal direction of said panel such that at least one of said plurality of slots is positionable in substantial registration with another one of said plurality of slots when said panel is coiled about an axis extending transversely with respect to a longitudinal extent of said panel.

2. The bag supporting device as in claim 1, wherein said panel has rounded corners.

3. The bag supporting device as in claim 1, wherein said panel has a thickness generally between 3/32 inches and ⅛ inches.

4. The bag supporting device as in claim 1, wherein said panel has a generally rectangular shape.

5. The bag supporting device as in claim 1, wherein said plurality of slots being substantially uniformly separated from each other on said panel for facilitating registration of a first pair of adjacent said lots with a second pair of adjacent said slots to permit extending both hands of a user through said adjacent slots when said panel is coiled.

6. The bag supporting device as in claim 1, wherein said plurality of slots are positioned adjacent to one of said top edge of said panel for permitting said plurality of slots to remain outside of a bag when a bottom portion of said panel is inserted into the bag.

7. The bag supporting device as in claim 1, wherein a separation between adjacent slots of said plurality of slots is substantially equal to a length of each of said slots.

8. The bag supporting device as in claim 1, wherein said plurality of slots comprises at least six slots.

9. The bag supporting device as in claim 1, wherein said plurality of slots extends along substantially the entire length of said panel.

10. The bag supporting device of claim 1 wherein said plurality of slots extends along substantially the entire length of said panel;

wherein said plurality of slots are substantially uniformly separated from each other on said panel for facilitating registration of a first pair of adjacent said lots with a second pair of adjacent said slots to permit extending both hands of a user through said adjacent slots when said panel is coiled;

wherein said plurality of slots are positioned adjacent to one of said top edge of said panel for permitting said plurality of slots to remain outside of a bag when a bottom portion of said panel is inserted into the bag;

wherein a separation between adjacent slots of said plurality of slots is substantially equal to a length of each of said slots; and wherein said plurality of slots comprises at least six slots.

11. A bag supporting device, the device being positionable in a collapsible bag, said device comprising:

a panel, said panel comprising a resiliently flexible material, said panel having a generally rectangular shape, said panel having a front surface, a back surface, an top edge, a bottom edge, and a pair of lateral side edges, said panel having rounded corners, said bottom and top edges having a length generally between 5 feet and 7 feet, each of said lateral edges having a length generally between 2½ feet and 3½ feet, said panel having a thickness generally between 3/32 inches and 1/8 inches, said resiliently flexible material comprising a plastic;

a plurality of slots being formed through said panel adjacent only the top edge, said plurality of slots being elongate for receiving a hand of a user for gripping said panel, each of the slots of said plurality of slots having a common longitudinal axis extending through each of said slots, said common longitudinal axis extending in a longitudinal direction of said panel such that at least one of said plurality of slots is positionable in substantial registration with another one of said plurality of slots when said panel is coiled about an axis extending transversely with respect to a longitudinal extent of said panel;

wherein said plurality of slots extends along substantially the entire length of said panel;

wherein said plurality of slots are substantially uniformly separated from each other on said panel for facilitating registration of a first pair of adjacent said lots with a second pair of adjacent said slots to permit extending both hands of a user through said adjacent slots when said panel is coiled;

wherein said plurality of slots are positioned adjacent to one of said top edge of said panel for permitting said plurality of slots to remain outside of a bag when a bottom portion of said panel is inserted into the bag;

wherein a separation between adjacent slots of said plurality of slots is substantially equal to a length of each of said slots; and wherein said plurality of slots comprises at least six slots.

* * * * *